US005735398A

United States Patent [19]

Price

[11] Patent Number: 5,735,398

[45] Date of Patent: Apr. 7, 1998

[54] GOLF BAG WITH SLIDABLE STRAP

[75] Inventor: David Price, Hendersonville, Tenn.

[73] Assignee: Wilson Sporting Goods Co., Chicago, Ill.

[21] Appl. No.: 757,142

[22] Filed: Dec. 3, 1996

Related U.S. Application Data

[63] Continuation of Ser. No. 378,408, Jan. 26, 1995, abandoned.

[51] Int. Cl.[6] ..... A63B 55/00

[52] U.S. Cl. ..... 206/315.3; 224/613

[58] Field of Search ..... 206/315.2–315.8; 224/600, 613

[56] References Cited

U.S. PATENT DOCUMENTS

| | | | |
|---|---|---|---|
| 1,570,500 | 1/1926 | Kennedy | 206/315.6 |
| 1,591,914 | 7/1926 | Farish | 206/315.7 X |
| 1,607,820 | 11/1926 | Frisk | 206/315.3 X |
| 1,726,245 | 9/1929 | Shelton | 206/315.6 X |
| 2,002,581 | 5/1935 | Osten | 206/315.8 |
| 2,091,298 | 8/1937 | Agnew | 206/315.6 X |
| 2,094,186 | 9/1937 | Patrick | 150/1.5 |
| 2,114,870 | 4/1938 | Calkins | 206/315.6 |
| 2,165,665 | 7/1939 | Thompson | 206/315.5 X |
| 2,437,405 | 3/1948 | Robinson | 206/315.3 X |
| 2,587,029 | 2/1952 | Burton, Jr. et al. | 150/1.5 |
| 2,698,040 | 12/1954 | Wilkens | 206/315.5 X |
| 2,704,563 | 3/1955 | Henrich | 150/1.5 |
| 2,736,357 | 2/1956 | Stamp | 206/315.5 |
| 2,861,613 | 11/1958 | Kish, Jr. | 150/1.5 |
| 2,861,614 | 11/1958 | Kish, Jr. | 206/315.5 X |
| 2,985,212 | 5/1961 | Dozier | 206/315.4 X |
| 3,259,160 | 7/1966 | Penna | 206/315.5 |
| 3,985,171 | 10/1976 | Summers et al. | 150/52 |
| 4,181,167 | 1/1980 | Ret | 206/315.6 |
| 4,249,586 | 2/1981 | Setani | 206/315.5 X |
| 4,263,950 | 4/1981 | Brown | 206/315.6 |
| 4,350,194 | 9/1982 | Brown | 206/315.5 |
| 4,699,164 | 10/1987 | Pilney et al. | 135/16 |
| 4,778,136 | 10/1988 | Reimers | 206/315.5 X |
| 4,779,725 | 10/1988 | Gerber | 206/315.3 |
| 4,953,768 | 9/1990 | Muse | 206/315.7 X |
| 5,024,259 | 6/1991 | Treadway | 150/159 |
| 5,029,703 | 7/1991 | Dulyea, Sr. | 206/315.3 |
| 5,038,984 | 8/1991 | Izzo | 224/209 |
| 5,042,703 | 8/1991 | Izzo | 206/315.5 X |
| 5,042,704 | 8/1991 | Izzo | 206/315.5 X |
| 5,094,283 | 3/1992 | Lawrence | 150/160 |
| 5,168,992 | 12/1992 | Bowdy | 206/315.6 |
| 5,176,253 | 1/1993 | Perrin et al. | 206/315.5 |
| 5,188,243 | 2/1993 | Ruiz | 206/315.3 X |
| 5,215,194 | 6/1993 | Blanford et al. | 206/315.3 |
| 5,222,596 | 6/1993 | Jordan | 206/315.6 |
| 5,222,598 | 6/1993 | Yamazoe | 206/315.5 |
| 5,267,660 | 12/1993 | Kwon | 211/70.2 |
| 5,280,798 | 1/1994 | Helm | 135/16 |
| 5,558,259 | 9/1996 | Izzo | 206/315.3 X |

FOREIGN PATENT DOCUMENTS

| | | | |
|---|---|---|---|
| 481773 | 3/1952 | Canada | 206/315.4 |
| 0 365 226 | 1/1932 | United Kingdom . | |
| 376766 | 7/1932 | United Kingdom . | |
| 414178 | 8/1934 | United Kingdom | 206/315.3 |
| WO91/09550 A1 | 7/1991 | WIPO . | |

*Primary Examiner*—Sue A. Weaver
*Attorney, Agent, or Firm*—Tilton, Fallon, Lungmus & Chestnut

[57] ABSTRACT

A golf bag includes a generally tubular bag portion with an elongate body, a bottom and an open top. A carrying strap that lies secured to the elongate body extends continuously from a first position at a top portion of the body to a second position a predetermined distance below the top portion. At least at one of the two positions, a connection secures the strap to the body and allows sliding movement of the strap a predetermined distance over the surface of the body between two stops.

3 Claims, 1 Drawing Sheet

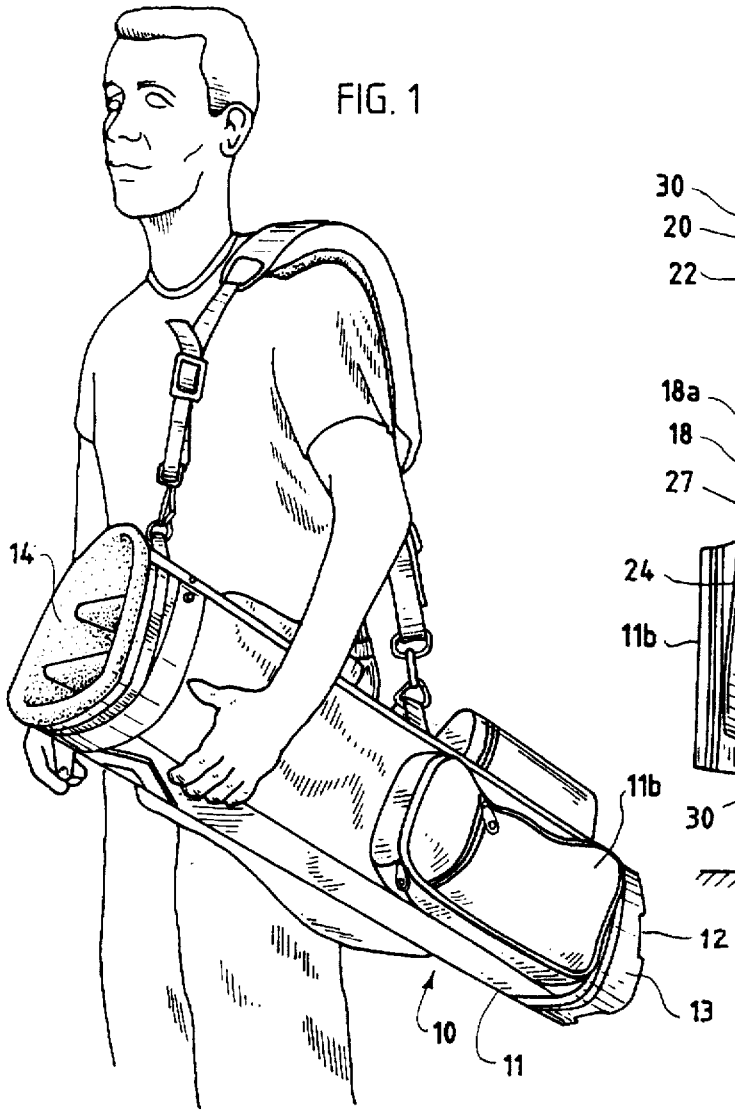
FIG. 1
FIG. 2
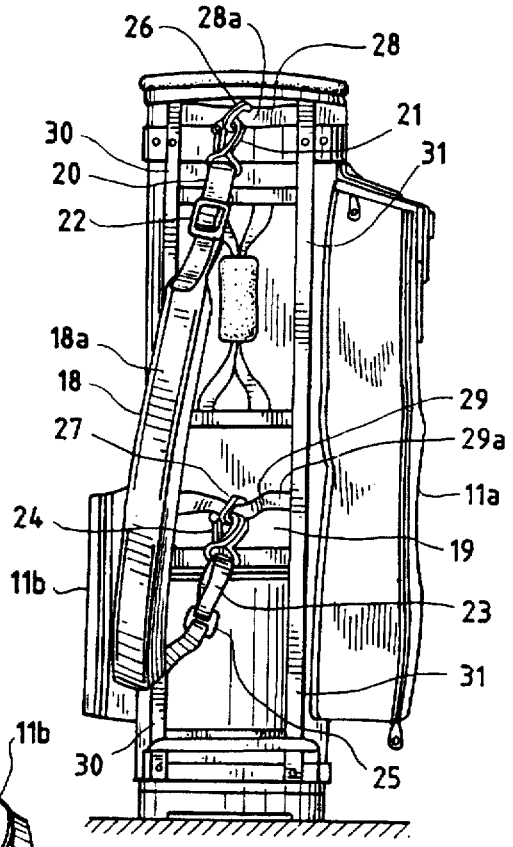
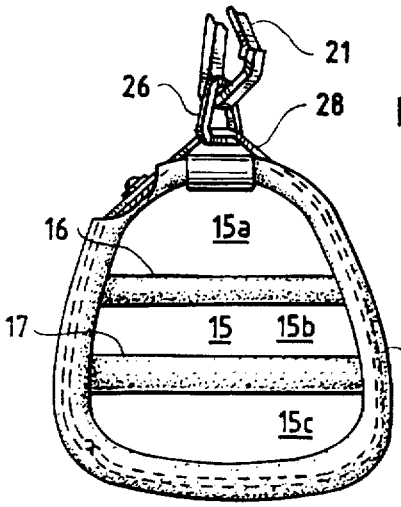
FIG. 3
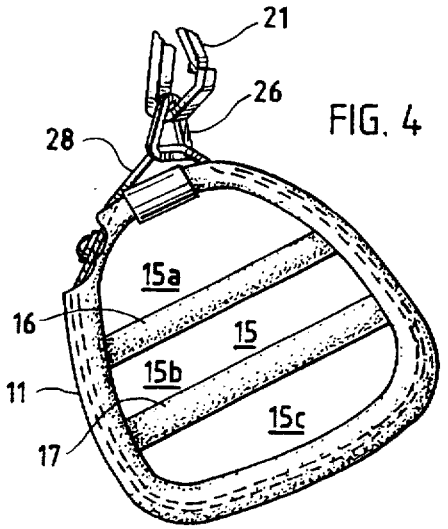
FIG. 4

GOLF BAG WITH SLIDABLE STRAP

This application is a continuation of application Ser. No. 08/378,408, filed Jan. 26, 1995, now abandoned.

BACKGROUND OF THE INVENTION

1. Field of the Invention

This invention relates to a golf bag with a slidable strap, and more particularly to a golf bag with a carrying strap slidably connected to the body of the golf bag, allowing the golf bag to adjust to a stable position.

2. Description of the Prior Art

A golf bag typically includes an elongate, tubular body closed at a bottom end by a base and open at a top end. It also includes a strap for carrying the bag. This strap extends from a top end portion of the tubular body to a mid portion; and various connecting devices secure the strap to the tubular body at those two locations.

The prior art includes a wide variety of straps; and various connecting devices for securing those straps to a bag body at predetermined points on the body. Although many of those straps include means for adjusting the length of the strap, they do not allow for adjustment of the connecting points between the strap and the body. U.S. Pat. Nos. 5,038,984; 5,0342,703; and 5,042,704 describe a golf bag and strap arrangement with adjustable connecting points. However, this arrangement includes a double-loop strap with three connecting points.

The golf bag of the present invention avoids the disadvantages of the prior golf bags. It includes a strap, slidably connected to the tubular body of the golf bag between two points to allow adjustment of the points of connection between the strap and the bag body. It allows the bag to self-adjust to a stable position, a position that "hugs" the body of the user. The strap assembly of this invention is a simple arrangement which allows easy carrying of the bag and minimizes the cost of manufacture of the golf bag.

SUMMARY OF THE INVENTION

In accordance with one embodiment of this invention, a golf bag includes a generally tubular bag portion with an elongate, tubular body, a bottom and an open top. A carrying strap that lies secured to the elongate body extends continuously from a first position at a top portion of the body to a second position a predetermined distance below the top portion. At least at one of the two positions, a connection secures the strap to the body and allows sliding movement of the strap a predetermined distance over the surface of the body between two stops.

BRIEF DESCRIPTION OF THE DRAWINGS

For a more complete understanding of this invention one should now refer to the embodiment illustrated in greater detail in the accompanying drawings and described below by way of an example of the invention. In the drawings:

FIG. 1 is a perspective view of the golf bag of the present invention hanging from the shoulder of an individual;

FIG. 2 is a side elevation view of the golf bag of FIG. 1;

FIG. 3 is a top end view of the golf bag of the present invention, showing the connection between the bag body and the strap; and FIG. 4 is the top end view of FIG. 3, showing the golf bag body tilted to one side.

While the following disclosure describes the invention in connection with one embodiment, one should understand that the invention is not limited to this embodiment. Furthermore, one should understand that the drawings are not to scale and that graphic symbols, diagrammatic representations, and fragmentary views, in part, may illustrate the embodiment. In certain instances, the disclosure may not include details which are not necessary for an understanding of the present invention, such as conventional details of fabrication and assembly.

DETAILED DESCRIPTION OF THE DRAWINGS AND AN EMBODIMENT

Turning now to the drawings, FIG. 1 shows the golf bag of the present invention generally at 10. The bag 10 includes an elongate, tubular body 11 closed at a bottom end 12 by a base member 13 and open at a top end 14. The body 11 may be fabricated from any suitable material, including any suitable, natural or synthetic, fabric material supported by bracing members such as spaced vertical rods and horizontal rings made of metal or any other material of sufficient strength and rigidity. The base member 13 may also be any suitable material (e.g., plastic).

The body 11 includes a plurality of pockets **11*a* and 11*b* for storing items such as balls, tees, and garments. It defines a central opening 15 divided into compartments 15*a*, 15*b*, and 15*c* by a pair of dividers 16 and 17. These compartments 15*a–c* receive a number of golf clubs. A player typically places the clubs into the bag by inserting the handle portion of the club into the body 11. The player may then load the bag onto his or her shoulder using a strap 18** and carry it to a desired location.

The strap 18 extends from the top end 14 of the bag to a middle portion 19 (See FIG. 2). It is a foldable elongate member made of nylon, polyester, or any other suitable material. A middle portion **18*a* of the strap 18 defines a pocket containing resilient material and functions as padding for the strap. One end portion 20 of the strap 18 extends through a snap hook 21, which connects the portion 20 to the body 11, and forms a loop. A strip adjusting member 22 secures the two end portions of the loop together and allows adjustment of the length of the loop and, accordingly the overall length of the strap 18**.

Similarly, another, opposite end portion 23 of the strap 18 extends through a snap hook member 24, which connects the portion 23 to the body 11 and forms a loop. A strip adjusting member 25 secures the two end portions of the loop together and allows adjustment of the length of the loop and, accordingly the overall length of the strap 18. The snap hook 24 connects the end portion 20 to a ring 26 slidably mounted to the body 11 at the top end 14; and the snap hook 24 connects the end portion 23 to a ring 27 slidably mounted to the body 11 at the middle portion 19.

The rings 26 and 27 have a triangular configuration and are made of metal, plastic or any other suitable material. These two rings 26 and 27 slide over strips or belts 28 and 29, respectively, between predetermined limits defined by the vertical belts 30 and 31. The belts 28 and 29 extend around the body 11 as shown in FIGS. 3 and 4. Suitable means such as stitching or rivets secure the belts 28 and 29 to the body 11 except the ring-supporting portions **28*a* and 29*a* between the belts 30 and 31. Similar means may secure the belts 30 and 31 to the body 11 of the bag 10. (The belts 28–31** may be any suitable foldable, flexible, or rigid material such as nylon or metal.)

When a player or user places the strap on his or her shoulder, the connections between the strap 18 and the body 11 of the bag allow the bag to shift and assume a stable position, a position that "hugs" the body of the player. This self-adjusting feature facilitates the transport of the bag 10 and increases the comfort of the one carrying it.

Although the embodiment described above includes sliding connections at both ends of strap 18, the bag 10 may include only one such connection, either at the top end of the bag or at the middle portion, with the other connection being a conventional fixed connection. Moreover, the sliding connection at the middle portion may lie at the bottom end of the body 11 or any other suitable location.

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. Therefore, by the appended claims, the applicant intends to cover any modifications and other embodiments as incorporate those features which constitute the essential features of this invention.

What is claimed is:

1. A golf bag comprising: a generally tubular bag portion having an elongate, generally rounded, tubular body with a longitudinal axis, a bottom, and an open top; a first foldable strip fixedly secured to a top portion of tubular body proximate the open top; a second foldable strip fixedly secured to the tubular body a predetermined distance below the first strip proximate a mid-portion of the tubular body; a foldable strap extending continuously between the first and second strips; a first ring member normally connected to the strap and disposed in sliding engagement with the first strip; a second ring member normally connected to the strap and disposed in sliding engagement with the second strip; stop means for limiting the movement of the first and second ring members; said strap extending from the first to the second strip without being connected to the tubular body between the first and second strips; said stop means including a pair of belt members disposed in spaced relation substantially longitudinally of the body; said first and second strips extending substantially around the entire body.

2. The golf bag of claim 1, wherein the strap includes a pair of clips for connecting opposite ends of the strap to the first and second ring members.

3. The golf bag of claim 2, wherein the ring members have a generally triangular configuration.

* * * * *